US005619811A

United States Patent [19]

Yrjölä

[11] Patent Number: 5,619,811

[45] Date of Patent: Apr. 15, 1997

[54] BUCKET EQUIPPED WITH GRINDING AND LOOSENING DEVICE

[76] Inventor: Mikko Yrjölä , Norolantie 12, FIN-15270 Kukkila, Finland

[21] Appl. No.: 360,771

[22] PCT Filed: Jun. 23, 1993

[86] PCT No.: PCT/FI93/00268

§ 371 Date: Feb. 7, 1995

§ 102(e) Date: Feb. 7, 1995

[87] PCT Pub. No.: WO94/00644

PCT Pub. Date: Jan. 6, 1994

[30] Foreign Application Priority Data

Jun. 23, 1992 [FI] Finland ..... 922918

[51] Int. Cl.[6] ..... E02F 3/00

[52] U.S. Cl. ..... 37/466; 37/444; 37/445; 37/903; 241/236

[58] Field of Search ..... 37/379, 443, 444, 37/445, 341, 466, 901, 903, 403; 241/236, 157; 171/63

[56] References Cited

U.S. PATENT DOCUMENTS

| | | | |
|---|---|---|---|
| 4,005,755 | 2/1977 | Bakk et al. | 37/452 X |
| 4,113,023 | 9/1978 | Baskett | 171/63 |
| 4,687,144 | 8/1987 | Irwin et al. | 241/326 X |
| 5,074,479 | 12/1991 | Lamar | 241/236 X |
| 5,248,100 | 9/1993 | Arakawa | 241/236 X |
| 5,379,534 | 1/1995 | Negishi | 37/241 X |
| 5,394,912 | 3/1995 | Hume | 241/236 X |
| 5,405,092 | 4/1995 | Jonninen | 37/403 X |
| 5,485,689 | 1/1996 | Jonninen | 37/406 X |

FOREIGN PATENT DOCUMENTS

| | | | |
|---|---|---|---|
| 86320 | 4/1992 | Finland . | |
| 88635 | 2/1993 | Finland . | |
| 361200225 | 9/1986 | Japan | 37/403 |
| 405346026 | 12/1993 | Japan | 37/443 |
| 408762 | 7/1979 | Sweden . | |
| 9209755 | 6/1992 | WIPO . | |

*Primary Examiner*—Randolph A. Reese
*Assistant Examiner*—Thomas A. Beach
*Attorney, Agent, or Firm*—Oblon, Spivak, McClelland, Maier & Neustadt, P.C.

[57] ABSTRACT

The invention relates to a device for handling material, especially soil, the device including a bucket (1) of a machine having a grinding device (2) for the material fitted thereto, the grinding device comprising at least two essentially parallel shafts (3) which are set at a distance from each other and rotatable in synchronization, the shafts having grinding members (4) for the material, whereby the grinding members (4) of two adjacent shafts overlap each other, the bottom of the bucket (1) including an outlet opening (5) for the handled material. The grinding members are provided with numerous discs (4) which are spaced apart from each other on each shaft (3), the peripheral surfaces of the discs comprising projections, whereby a notch is provided between two adjacent projections. In addition, the bucket (1) includes a loosening device (6) for the material lodged between the grinding device (2) and the outlet opening (5), the loosening device comprising at least two essentially parallel shafts (7) which are set at a distance from each other and rotatable in synchronization and which includes blades (8) for loosening the ground material obtained from the grinding device (2).

8 Claims, 3 Drawing Sheets

BUCKET EQUIPPED WITH GRINDING AND LOOSENING DEVICE

BACKGROUND OF THE INVENTION

1. Technical Field

The invention relates to a device for handling material, especially soil, the device consisting of a bucket of a machine having a grinding device for material fitted thereto, the grinding device comprising at least two essentially parallel shafts which are at a distance from each other and rotatable in synchronization, the shafts comprising grinding members for the material, whereby the grinding members of two adjacent shafts overlap each other, the bottom of the bucket comprising an outlet opening for the handled material.

2. Background Art

The materials to be handled include, in particular, different soils such as compost, peat, and waste soil as well as different waste materials.

The bucket of the above described type which is especially intended to be used as the bucket of an excavator and for grinding soil, is known from FI patent application 902469. The grinding members on the shafts of the grinding device in this known bucket construction consist of radial blades welded on the shafts which mix and grind the soil to be handled. A disadvantage of this construction is that the blade can be twisted by stones or the like resulting in the twisted blade colliding with the blade on the adjacent shaft, whereby the bucket must be stopped and removed for repair. Another disadvantage of the described construction is that roots or the like can become tangled with the blades resulting in jamming the device. The handled soil would not be very loose, either, nor would it be sufficiently high-quality for demanding uses.

3. Disclosure of the Invention

Screening plants are also well known which handle compost using large drum screens. Such plants are very expensive and require separate transporting equipment if they are to be transferred from one place to another.

The purpose of this invention is to provide a device which avoids the above-described drawbacks of known devices, and the purpose of the invention is namely to provide a device which is very reliable and comprises a minimum number of parts which wear and are apt to break, and which, in addition to effectively screening and grinding the material to be handled, also renders it a loose form.

An important object of the invention is thus to provide a device which produces very high-quality soil which suits demanding uses very well.

These objects can be realized by the device according to the invention, the main characteristics of which are disclosed in the appended Claims.

The invention is based on the realization that a bucket construction is provided comprising a grinding device which includes effective and strong grinding members and which screens and grinds the material to be handled, and a loosening device which renders the screened and ground material in a loose form resulting in very high-quality material.

Thus the bucket according to the invention, which preferably is a bucket of a wheel loader, comprises a grinding device for the material fitted to the bucket, the grinding device including at least two, preferably four, essentially parallel shafts which are at a distance from each other and rotatable in synchronization and which comprise grinding members for the material consisting of numerous discs which are spaced from each other on each shaft, the discs having projections on the peripheral surface thereof, whereby a notch is provided between two adjacent projections. The grinding members of the two adjacent shafts overlap each other. The bottom of the bucket is provided with an outlet opening for the handled material.

As described above, the bucket according to the invention further comprises a loosening device which is fitted between the grinding device and the outlet opening and which comprises at least two, but preferably two, essentially parallel shafts which are spaced from each other and rotatable in synchronization, including aeration blades for loosening the ground material. The aeration blades are preferably shaped like propellers.

According to the invention, also a bar screen can be fitted into the bucket which screens, for example, stones, stubs, roots and similar large-sized items out of the compost. Such a bar screen is fitted above the shafts of the grinding device, preferably so that the ribs of the bar screen are between the planar parts of the overlapping discs.

The above-mentioned discs preferably comprise an essentially tooth-like shape and according to a preferred embodiment of the invention, the teeth comprise a widening part extending from the tooth to the notch situated after the tooth in the direction of rotation of the disc.

According to the invention, the shape of the shafts of the grinding device is preferably polygonal, especially preferably hexagonal, whereby the discs comprise a corresponding polygonal bore. This construction ensures that the discs are rotated along with the shaft.

In order to keep the desired distance between the discs on the same shaft, a spacing sleeve with a length corresponding to the desired distance between the discs can be fitted between the discs and around the shaft.

The grinding device and the loosening device are driven by hydraulic motors which are connected to the hydraulic system of the machine. The shafts of the grinding device are advantageously rotated in the same direction, the speed of rotation being typically about 100 to 150 rpm. The shafts of the loosening device are rotated at a considerably higher velocity than the shafts of the grinding device, the typical speed of rotation being about 400 to 500 rpm. Depending on the construction of the aeration blades, the shafts of the loosening device can be rotated either in the same direction or in different directions.

BRIEF DESCRIPTION OF THE DRAWINGS

In the following the invention is described in more detail with reference to the appended drawings, in which.

BEST MODE FOR CARRYING OUT THE INVENTION

Figure 1:
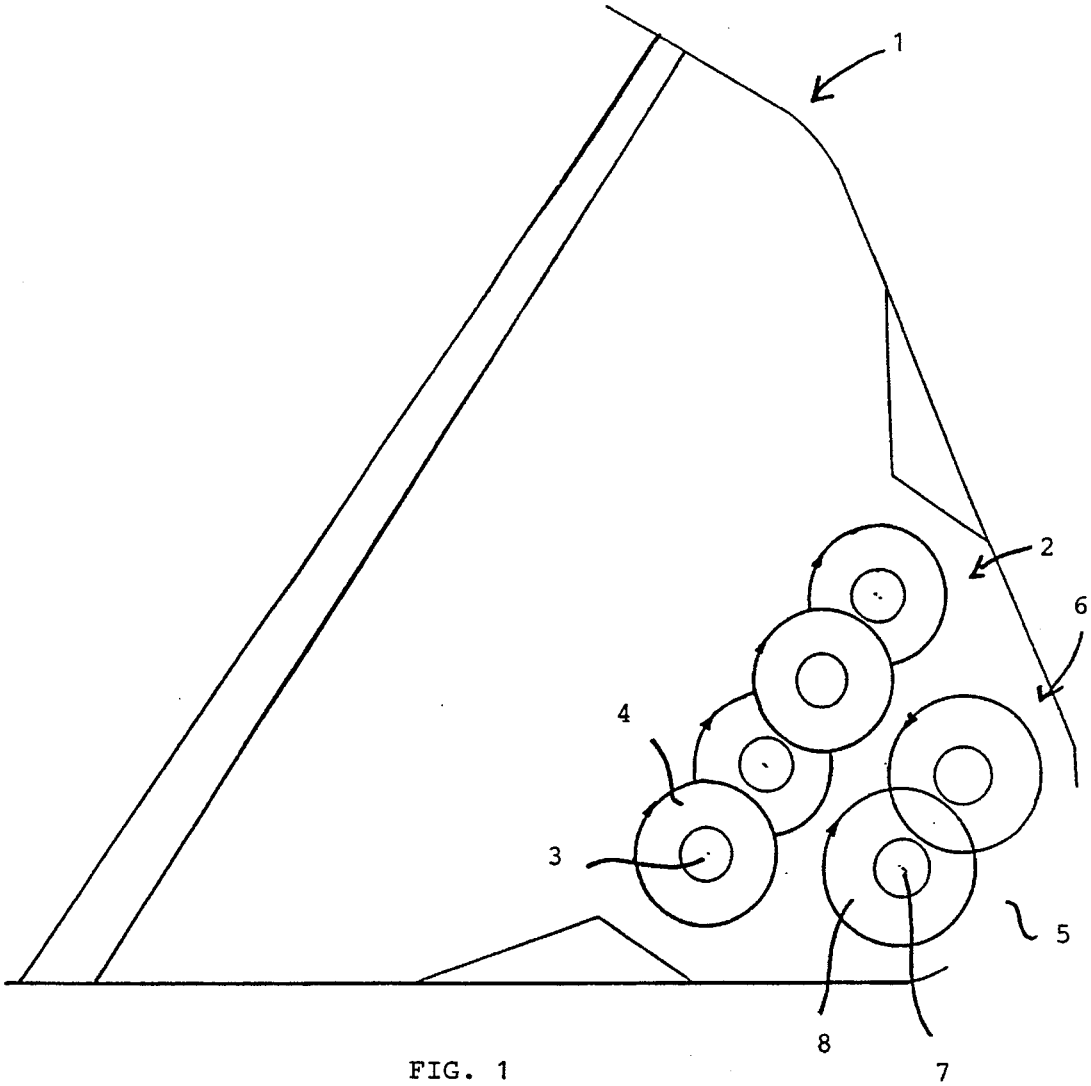
FIG. 1 represents a simplified section of a preferred bucket according to the invention.
Figure 2:
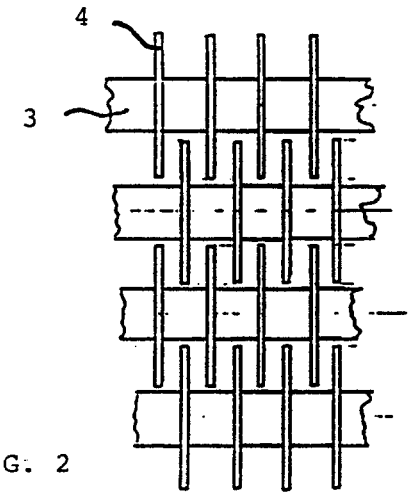
FIG. 2 represents the same construction, as in FIG. 1, in a partial view as viewed from the mouth of the bucket.

Referring to FIG. 1, the bucket of a wheel loader is generally marked with reference number 1. The bottom of bucket 1 comprises outlet opening 5 for the material.

Bucket 1 comprises a grinding device 2 for the material and a loosening device 6 for the ground material being fitted below it.

Grinding machine 2 comprises, in this instance, four essentially planar, essentially parallel shafts 3 which are spaced from each other and rotatable in synchronization. Shafts 3 are preferably rotated in the same direction by a hydraulic motor (not shown in the Figs.) using conventional transmissions. The hydraulic motor is connected to the hydraulic system of the wheel loader.

A large number of discs 4 are fitted to the shafts 3 and spaced from each other. Shafts 3 extend from one side portion of the bucket to the other. Shafts 3 and discs 4 on them are fitted with respect to each other in such a way that the discs of the second shaft are laterally displaced with respect to the discs of the first shaft so that the disc of the first shaft is in the middle of two adjacent discs of the second shaft. In addition, the discs of two adjacent shafts overlap each other. The discs of the third shaft are aligned with the discs of the first shaft and the discs of the fourth shaft are aligned with the discs of the second shaft.

The material scooped into bucket 1 is subjected to the grinding device 2 which loosens, for instance, stones, stubs, and roots and other large-size parts from the compost that have become lodged between grinding valve 1 and outlet 5.

Figure 5:
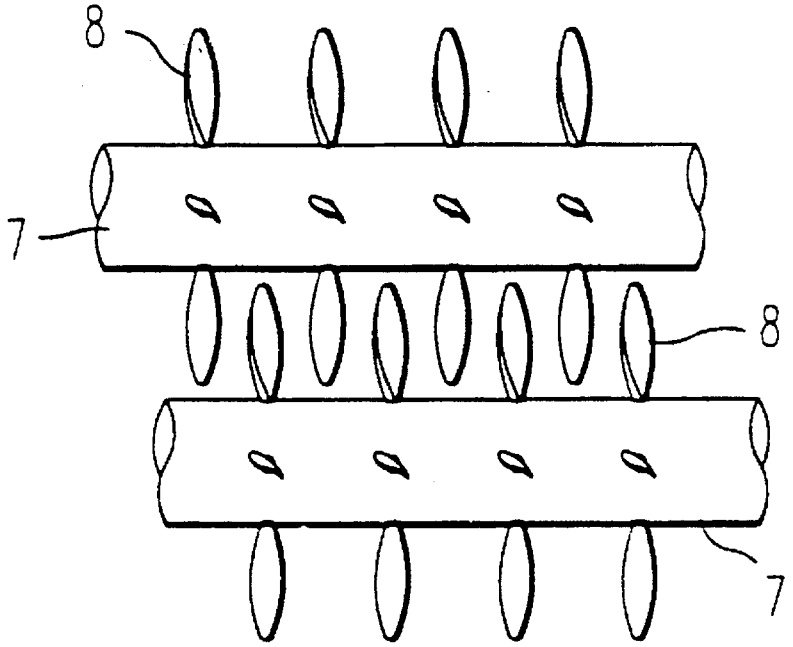

Grinding machine 2 comprises a plurality of rotating discs 4 which grind material. The screened and ground material acted on by the grinding machine 3 is then subjected to loosening device 6 which in this example comprises two essentially parallel shafts 7 which are spaced a distance from each other and rotatable in synchronization, including propeller-like aeration blades 8 as shown in FIG. 5. Shafts 7 are rotated with the aid of a hydraulic motor (not shown) which is connected to the hydraulic system of the wheel loader. The screened, ground and loosened material obtained from loosening device 6 is extremely fine-grained and high-quality.

Figure 3:
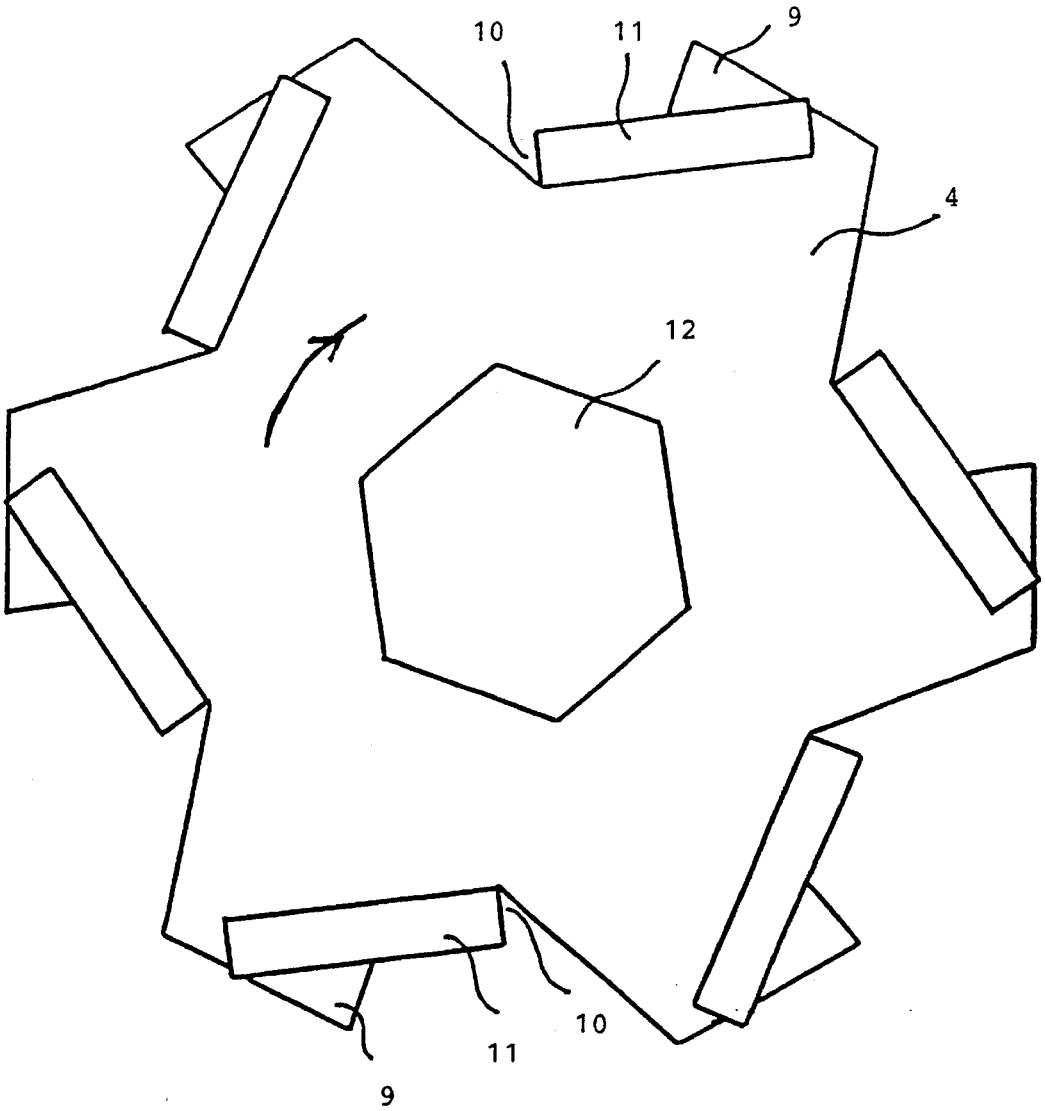
FIG. 3 represents a detail shown in FIG. 1 on an enlarged scale.
Figure 4:
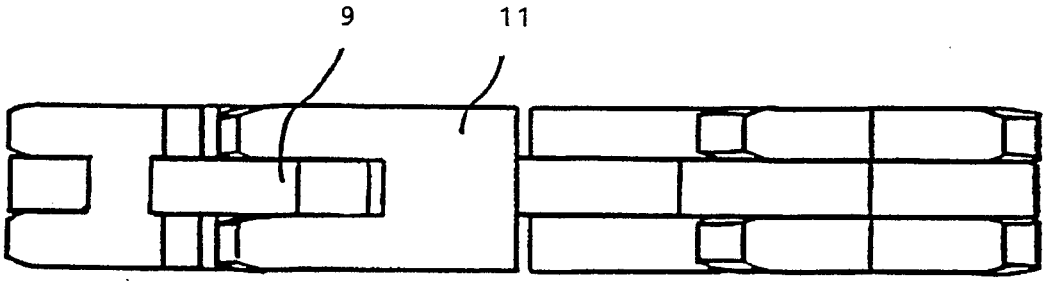
FIG. 4 represents the same construction as in FIG. 3 as viewed from another direction and FIG. 5 shows a top plan view of the aeration blades.

FIGS. 3 and 4 show a preferred shape of discs 4. These discs 4 granulate and grind material very effectively. Discs 4 mainly consist of a tooth-like shape comprising, in this example, six teeth and six notches between the teeth, respectively. Each tooth 9 has a widening part 11 attached thereto and extending from tooth 9 to adjacent notch 10 which is situated after tooth 9 in the direction of rotation of disc 4. Widening part 11 is formed of a rectangular metal piece comprising a chain link the width of which corresponds to the thickness of the disc. This widening part 11 is welded to disc 4. While discs 4 rotate, widening parts 11 take the material on top of the discs to the space below the discs where loosening device 6 is situated.

The shaft 3 of the grinding device 2 preferably comprise a hexagonal shape, and discs 4 correspondingly comprise a hexagonal opening 12 for the shaft 3 (see FIG. 3). Due to this construction, the discs 4 rotate in a controlled manner along with shafts 3. Spacing sleeves are fitted between adjacent discs 4 and positioned around the shaft 3. The sleeves at the end of the shaft are fixedly attached to the shaft, for instance, by welding or in another manner. If one of the discs for one reason or another must be replaced with another one, this is simply done by disconnecting the end sleeve fastener and taking away the desired number of sleeves and discs from the shaft and then the desired number of discs and sleeves are refitted on the shaft.

Using the bucket according to the invention, compost or like material can be lifted straight from the ground and discharged through a grinding device and a loosening device onto the body of a truck, for instance. Correspondingly, using the bucket according to the invention compost or like material can be lifted, for instance, from the body of a truck and discharged through a grinding device and a loosening device straight to the ground.

I claim:

1. A device for handling material, comprising a bucket of a machine having a grinding device grinding material fitted thereto, the grinding device comprising:

at least two substantially parallel shafts which are spaced from each other and are rotatable in the same direction in synchronization, the shafts comprising grinding members grinding the material, wherein the grinding members of two adjacent shafts overlap each other, the bottom of the bucket includes an outlet opening for the handled material, the grinding members include discs which are spaced from each other on each of the shafts, the peripheral surfaces of the discs comprising projections, and wherein a notch is provided between two adjacent projections, and the bucket includes a loosening device loosening material lodged between the grinding device and the outlet opening, the loosening device having at least two essentially parallel shafts which are spaced from each other, are rotatable in synchronization and which include aeration blades loosening the ground material obtained from the grinding device.

2. A device according to claim 1, wherein the discs comprise a substantially tooth-like configuration.

3. A device according to claim 2, wherein the teeth comprise a widening part.

4. A device according to claim 3, wherein the widening part extends from the tooth to an adjacent notch situated in proximity with the tooth in a direction of rotation of the disc.

5. A device according to claim 1, wherein the shafts of the grinding device comprise a polygonal shape, and the discs comprise a corresponding polygonal shaped bore.

6. A device according to claim 5, wherein said polygonal shape comprises a hexagonal shape.

7. A device according to claim 1, wherein between two adjacent discs on the same shaft, spacing sleeves are fitted around the shaft.

8. A device according to claim 1, wherein the aeration blades have a propeller-like shape.

* * * * *